US005294207A

United States Patent [19]

Keating et al.

[11] Patent Number: 5,294,207

[45] Date of Patent: Mar. 15, 1994

[54] FLOW-THROUGH BRUSH LIQUID APPLICATOR

[75] Inventors: Richard J. Keating, Mahwah; Harley H. Mattheis, Verona, both of N.J.; Jerald R. Melcher, Omaha, Nebr.

[73] Assignee: Nagl Manufacturing Co., Omaha, Nebr.

[21] Appl. No.: 924,722

[22] Filed: Aug. 3, 1992

[51] Int. Cl.[5] ..... A46B 3/10; A46B 7/00; A46B 9/02

[52] U.S. Cl. ..... 401/288; 401/290

[58] Field of Search ..... 401/286, 288, 290, 176, 401/289

[56] References Cited

U.S. PATENT DOCUMENTS

| | | | |
|---|---|---|---|
| 1,006,641 | 10/1911 | Fisler | 401/290 X |
| 1,047,878 | 12/1912 | Avery | 401/286 X |
| 1,321,907 | 11/1919 | Graham | 401/286 X |
| 1,681,836 | 8/1928 | Boka | 401/288 |
| 1,725,464 | 8/1929 | Lysons | 401/288 |
| 2,236,030 | 3/1941 | Hall | 401/288 |
| 2,272,641 | 2/1942 | Mureau | 401/288 |
| 2,422,823 | 6/1947 | Christensen | 401/290 X |
| 4,881,289 | 11/1989 | Tsuzoshi et al. | 401/288 X |

FOREIGN PATENT DOCUMENTS

| | | | |
|---|---|---|---|
| 3641391 | 2/1988 | Fed. Rep. of Germany | 401/288 |

*Primary Examiner*—Danton D. DeMille
*Attorney, Agent, or Firm*—Vincent L. Carney

[57] ABSTRACT

A brush applicator includes inner and outer shells with a cylindrical brush mounted to the inner shell in a cylindrical groove rimmed by clamping means that are compressed against the brush when the outer shell is forced over the inner shell.

3 Claims, 4 Drawing Sheets

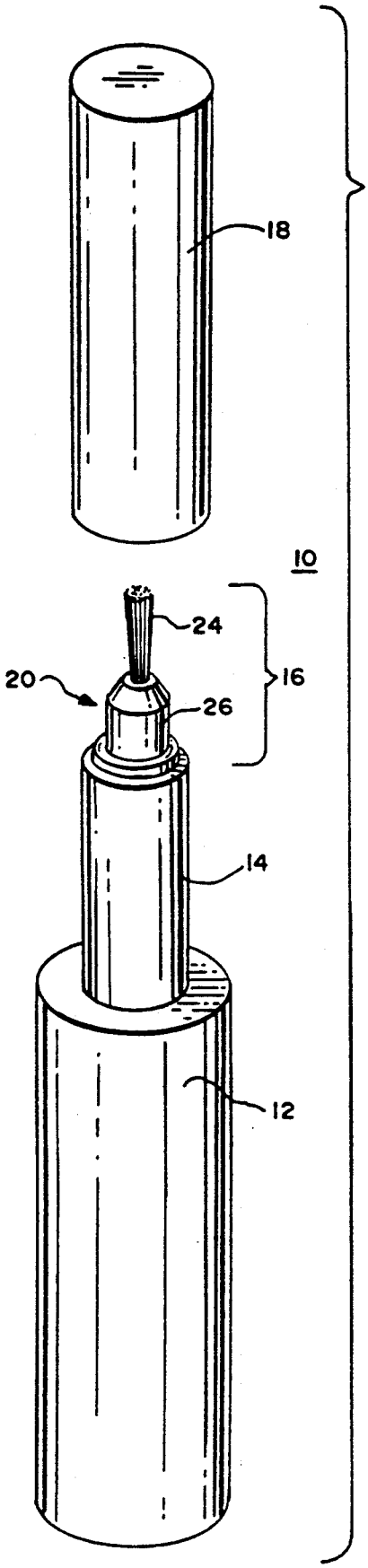
FIG. 1
FIG. 2
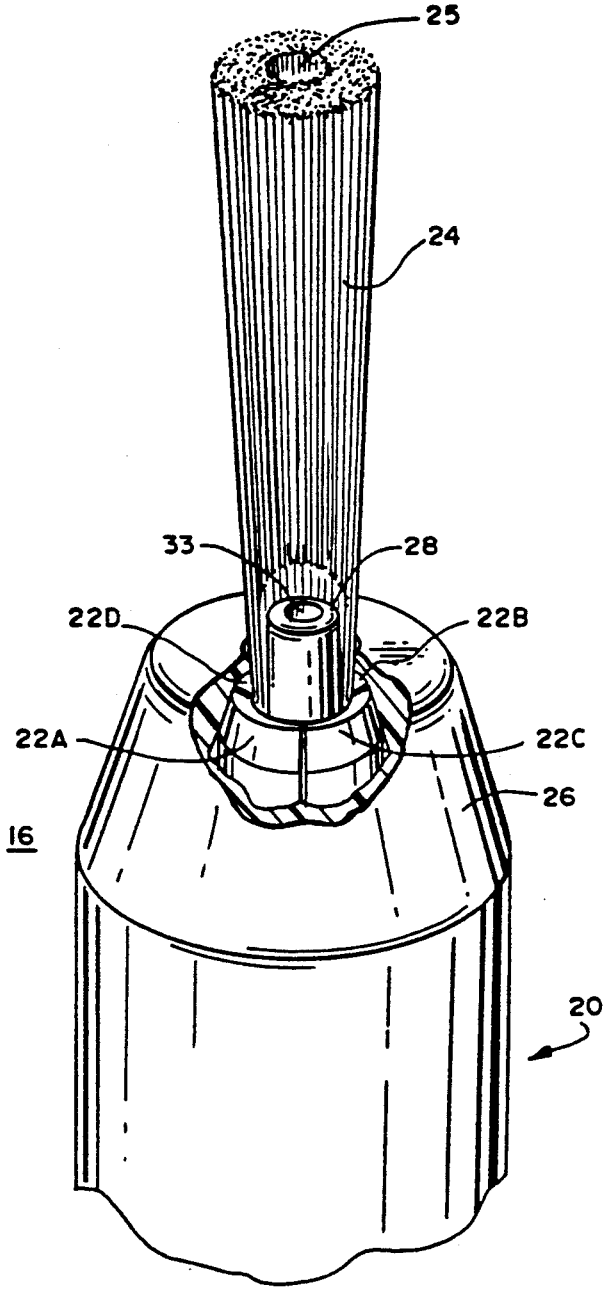

FLOW-THROUGH BRUSH LIQUID APPLICATOR

BACKGROUND OF THE INVENTION

This invention relates to liquid applicators and more particularly to flow-through brush liquid applicators in which the liquid flows through the bristles of a brush that may be used to spread the liquid, such as for example fingernail polish applicators.

In one class of flow-through brush liquid applicator, the outlet in a container for the liquid is partly closed by the bristles of a small brush but there is sufficient space provided so that liquid may flow from the container and wet the bristles of the brush as the liquid is applied to a surface. A prior art type of applicator of this class utilizes a staple that is stapled through the bristles to fasten them into the outlet of the container. It has been proposed to position the bristles at the wall of a tubular cylinder through which the liquid may flow.

The prior art type of flow-through applicators have the disadvantages of being relatively expensive and time-consuming to fasten in place to a container.

SUMMARY OF THE INVENTION

Accordingly, it is an object of the invention to provide a novel flow-through applicator.

It is a further object of the invention to provide a novel method of fabricating a flow-through applicator.

It is a still further object of the invention to provide a method of manufacturing a flow-through brush applicator in which the liquid being applied from a container flows through a central opening surrounded by bristles.

It is a further object of the invention to provide a flow-through brush holder that is easily assembled to an applicator.

In accordance with the above and further objects of the invention, a flow-through brush is: (1) formed to have a central opening; and (2) inserted into a brush holder having an opening, with the opening of the brush holder extending part-way into the central opening of the bristles. One end of the bristles are within an annular groove circumscribing the opening in the brush holder.

To hold the bristles in place, a plurality of clamp means surround the annular groove, which is formed in an inner shell of the brush holder. These clamp means are adapted to hold the bristles in place upon final assembly of the brush holder. Final assembly of the brush holder is accomplished by pressing an outer brush holder shell over the inner shell in which the groove is located, with the tip of the inner shell having the outlet opening and the ends of the bristles extending from the outer shell.

The brush holder of this invention may be fixed in place at the outlet of a liquid applicator such as for example a nail polish brush applicator. In this arrangement, the nail polish applicator includes at its outlet the outer and inner shells holding the bristles and forming a bristle-lined tubular-cylindrical outlet. The interior of the inner shell communicates with the interior of the container at one end and with its outlet at the other end through a circle of bristles.

The clamp members may be arcuate wall sections of a truncated tubular cone that are separated from each other but may be pressed inwardly in a direction that tends to form a continuous wall of the tip of a tubular truncated cone circumscribing a narrow cylindrical tubular nose of the inner shell. When pressed together, the clamp means compress one end of the bristles to hold them at the one end against the narrow cylindrical tubular nose of the inner shell, the distal end of the nose being open to permit liquid from the container to flow out of the nose and onto the bristles which surround it. The clamp members are sufficiently flexible to bend inwardly until they are touching or nearly touching each other.

From the above description, it can be understood that, the applicator and method of fabricating the applicator of this invention has several advantages, such as for example: (1) it enables easy assembly of the brushes to a brush holder and to a container; and (2) it is a relatively inexpensive efficient applicator which permits the flow of liquid through the center of the bristles of a brush.

SUMMARY OF THE DRAWINGS

The above-noted and other features of the invention will be better understood from the following detailed description when considered with reference to the accompanying drawings, in which:

FIG. 1 is a perspective view of a flow-through brush applicator in accordance with an embodiment of the invention;

FIG. 2 is an enlarged, fragmentary, partly broken-away view of the tip of the container of FIG. 1 including a portion of the novel brush holder;

DETAILED DESCRIPTION

Figure 3:
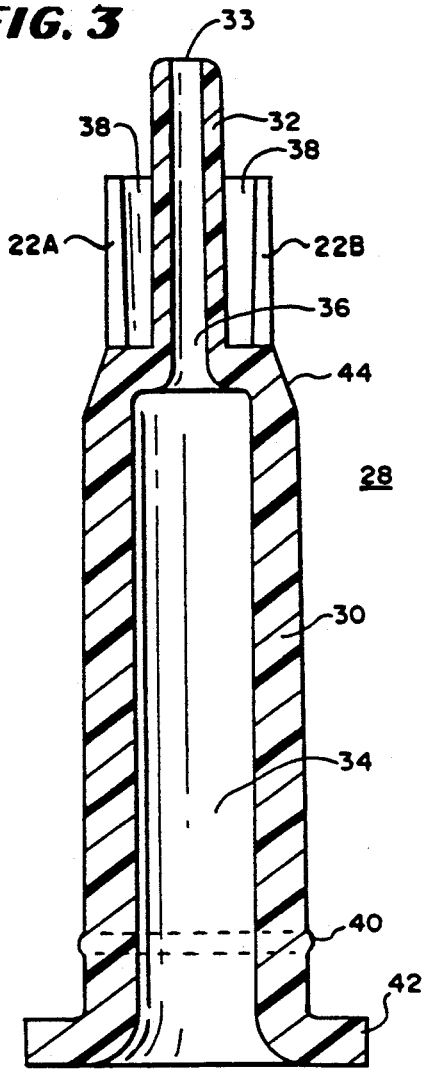
FIG. 3 is a longitudinal sectional view of a portion of the brush holder of FIGS. 1 and 2.

In FIG. 1, there is shown a flow-through applicator 10 having a container body 12, a neck for the container shown at 14, a container tip 16 and an applicator cap 18. In the preferred embodiment, the neck 14 is narrower than the container body 12 and contains threads adapted to engage threads in the cap 18 to provide a protective cover over the flow-through applicator 10. The tip 16 extends from the neck portion 14 and contains the brush so that, when the container is inverted, fluid flows through the brush for application to a surface, such as for example to fingernails. The cap 18, when closed, encloses the brush at the tip 16.

The tip 16 includes a flow-through brush holder 20 having extending from it a flow-through brush 24. The brush holder 20 includes four clamp members 22A–22D that hold the brush bristles in place so that they extend from an outer shell 26 of the tip 16. The tip 16 is easily assembled to the neck portion 14 of the container 12 and is easily fabricated to hold the flow-through brush in place for application of a liquid through the bristles of the brush.

In FIG. 2, there is shown an enlarged fragmentary view, partly broken away, of the tip 16 showing a portion of the flow-through brush 24 with an opening in the center indicated at 25 and extending from the outer tip of an inner shell 28 to which the bristles of the brush are clamped by clamp members 22A–22D (22A and 22B being shown in FIG. 2). The clamp members 22A–22D are moved in place by the outer shell 26, the top portion of which is shown at 26 in FIG. 2. As best shown in this view, the bristles of the brush 24 surround the outlet of the container so that fluid flowing from the outlet wets the brush 24 as the liquid is applied.

In FIG. 3, there is shown a longitudinal sectional view of the inner shell 28 having an inner shell body 30, an inner shell nose 32, a plurality of clamp members 22A and 22B being shown in FIG. 3, an inner shell passageway 34, an inner shell nose passageway 36 and a cylindrical-tubular outlet opening 38. These parts are arranged to permit the fluid to flow from the inside of the container such as a container 12 (FIG. 1) through the inner shell body passageway 34 and inner shell nose passageway 36 into the center of the brushes 24 (FIG. 1 and FIG. 2). In the preferred embodiment, the inner shell body 30, inner shell nose 32 and clamps 22A–22D (22A and 22B being shown in FIG. 3) are integrally formed of a plastic material but of course can be made in many different ways.

The inner shell body 30 is generally tubular and cylindrical: (1) enclosing the inner shell passageway 34 which extends through it along its longitudinal axis; (2) having at its lower end a flange 42; (3) having an annular groove 40 in its outer surface, spaced a short distance from the flange 42 toward an outlet 33 and serving as one locking member; and (4) having an inwardly conical surface at 44 leading to the clamp members 22A–22D which surround the extending inner shell nose 32.

The inner shell nose 32 includes an elongated tubular wall of narrower diameter than the inner shell body 30 surrounding the inner shell nose passageway 36 which joins the inner shell body passageway 34 at one end and extends to the outlet 33 at its other end, with the outlet 33 extending into the tubular opening in the center 25 of the brushes 24 (FIG. 2). The outer circumferential wall of the inner shell nose 32 forms an inner part of the clamp means for the bristles of the flow-through brush 24.

The clamp means 22A–22D, two members of which are shown at 22A and 22B, are arcuate, being shaped as segments of a truncated cone separated from each other and surrounding the cylindrical tubular outlet opening 38 which circumscribes the nose portion 32. The outlet opening 38 receives one end of the flow-through brush 24 (FIGS. 1 and 2). The clamp members 22A–22D press against the brush 24 and form the outer part of the clamp means so that the brush 24 is held between the outer surface of the inner shell nose 32 and the inner surface of the clamp means 22A–22D which, when bent inwardly in a manner to be described hereinafter, form an outer ring to hold the brush 24 in place.

In the preferred embodiment, the inner diameter of the inner shell passageway 34 is approximately 0.118 inches, the cylindrical wall is 0.050 inches thick, the diameter from the outer ends of the circular flange 42 is 0.318 inches, the length of the inner shell body 30 is 0.2 inches, the inner diameter of the inner shell nose passageway 36 is 0.028 inches and its wall diameter is 0.066 inches. The conical surface 44 is at an angle of 20 degrees to the longitudinal axis of the inner shell 28, the outer diameter of the annular groove 40 is 0.125 inches and its inner diameter (outer diameter of the inner shell nose) is 0.066 inches and the entire length of the inner shell 28 is 0.930 inches.

Figure 4:
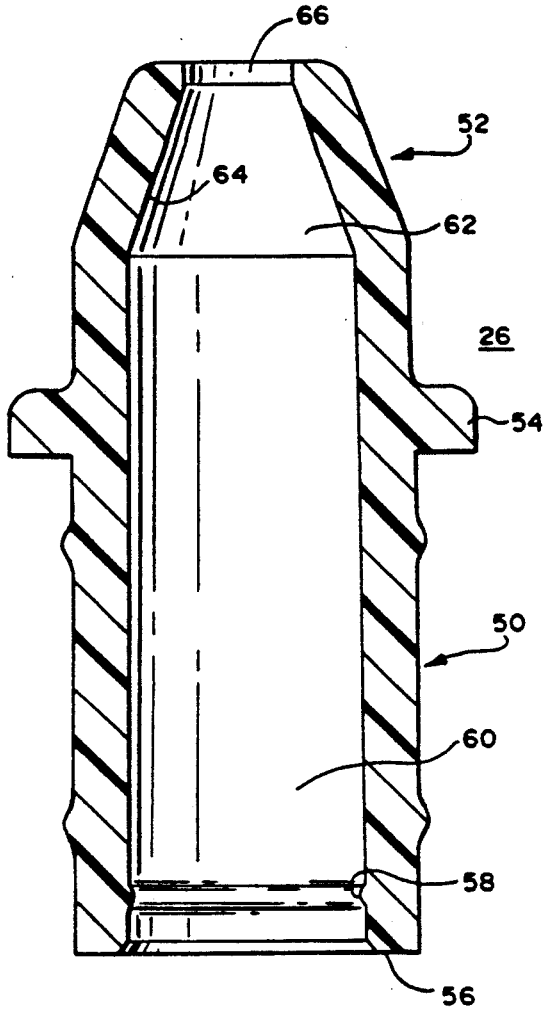
FIG. 4 is a longitudinal sectional view of another portion of the brush holder of FIGS. 1 and 2.

In FIG. 4, there is shown a longitudinal sectional view of the outer shell 26 having a tubular generally cylindrical portion 50 and a tubular frustum of a right regular cone section 52 integrally formed with each other to receive the body portion of the inner shell 28 (FIG. 3) within a passageway 60 of the right regular cylindrical portion 50 and the inner shell nose portion 32 (FIG. 3) within an inner passageway 62 of the tubular right regular frustum of a cone section 52 so that the inner shell nose 32 (FIG. 3) fits through an opening 66 in the outer shell 26.

The tubular right-regular-cylindrical portion 50 includes an annular stop surface 56, an annular boss internal to the passageway 60 shown at 58 and an outwardly extending flange 54. The outer shell 26 is adapted to receive the inner shell 28 with the top of the flange 42 (FIG. 3) of the inner shell 28 resting upon the stop surface 56 of the outer shell 26, the annular groove 40 (FIG. 3) of the inner shell 28 receiving the inward boss 58 of the outer shell 26 to hold it in place and the conical surface 44 (FIG. 3) resting against the inner conical surface 64 of the frustum of the cone 52.

With this arrangement, the outer shell 26 can be forced over the inner shell 28 and locked in place to force the clamp members 22A–22D (FIG. 3) inwardly to hold the brush 24 in place. In the preferred embodiment, the inner diameter of the inner passageway 60 is 0.210 inches, the boss 58 and groove 40 (FIG. 3) which match have a radius of 0.01 inches, the outer opening 66 through which the nose 32 passes in the frustum of a cone section 52 has an inner diameter of 0.1 inches, the conical surface 64 is at an angle of 20 degrees with the longitudinal axis of the outer shell 26, the length to the flange 54 from the stopping surface 56 is 0.460 inches and the total length is 0.820 inches with a wall thickness of approximately 0.045 inches.

While two locking members including the boss 58 in the outer shell 26 and the groove 40 in the inner shell 28 (FIG. 3) are provided, any other snap mechanism could be used, and the groove 40 and boss 58 could be reversed as between the inner and outer shell with the boss being on the outer surface of the inner shell and the groove being in the inner surface of the outer shell if desired. Similarly, many other configurations could be utilized such as square shell members or the like to provide clamping around the outlet to fasten easily the flow-through brush 24 in place.

Figure 5:
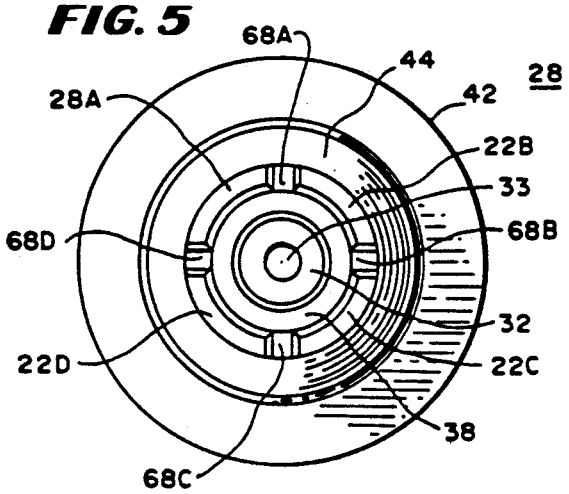
FIG. 5 is a plan view of the brush holder portion shown in the longitudinal sectional view of FIG. 3.

In FIG. 5, there is shown a plan view of the inner shell 28 showing the bottom flange 42, the conical section 44, the four clamp members 22A–22D, the tubular outlet opening 38 into which the bristles of the brush are inserted, the inner shell nose 32 and the outlet 33. As shown in this view, there are openings 68A–68D between the curved clamped members 22A–22D which permit these members to be bent radially inwardly toward the outlet 33 until they approximately touch each other and force themselves against the bristles of the brush 24 (FIGS. 1 and 2).

Figure 6:
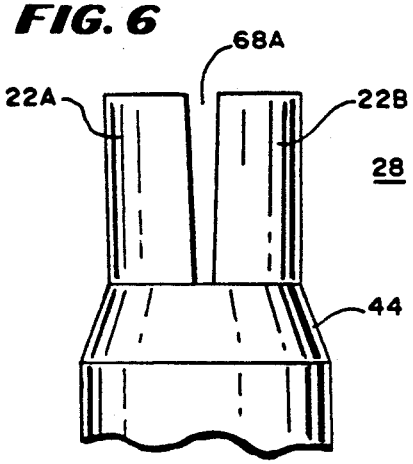
FIG. 6 is an enlarged fragmentary view of a portion of the brush holder inner shell that is a portion of the embodiment of brush holder of FIGS. 3 and 5.

In FIG. 6, there are shown two of the clamp members 22A and 22B separated by the opening 68A and extending from the conical portion 44 illustrating the manner in which the space between them slopes so that they may be bent inwardly until they approximately touch.

Figure 7:
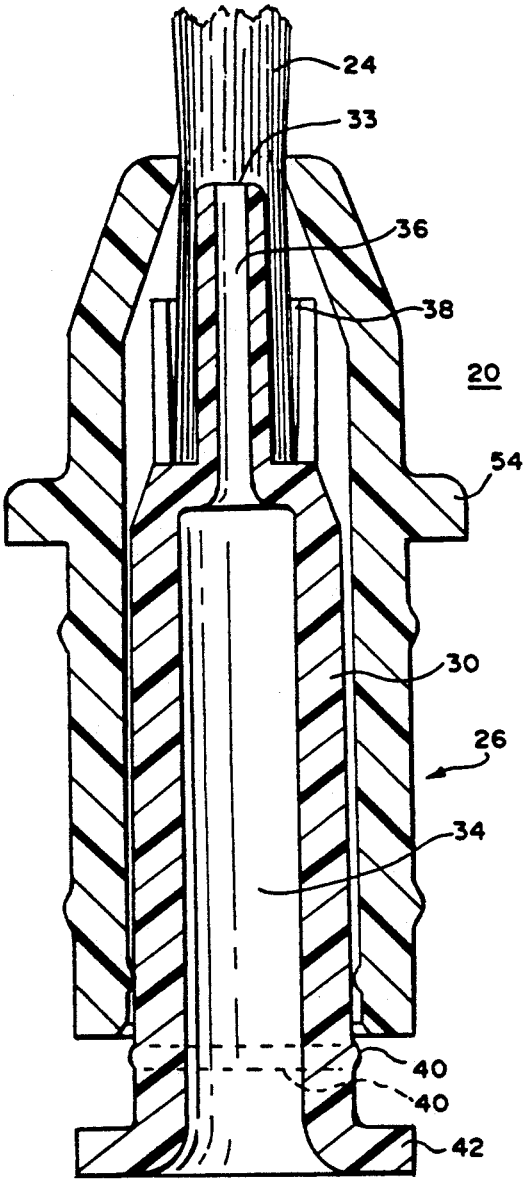
FIG. 7 is a sectional view showing one stage in the assembly of the inner member of FIG. 3 to the outer member of FIG. 4 to prepare a brush holder as shown in FIG. 1.

In FIG. 7, there is shown a longitudinal sectional view 20 of the inner shell member 28, the outer shell member 26, and the brush fibers 24 in one position during the assembly of the brush tip 16 (FIG. 1). In this position, the outer shell 26 has already been positioned above the inner shell 28 and the brush 24, with the brush 24 having been inserted in the tubular outlet opening 38 so that the top of the brush 24 fits within the wide bottom end of the outer shell 26 and is forced inwardly through the opening at the top of the outer shell 26 by the conical portions at the top of the outer shell 26.

Figure 8:
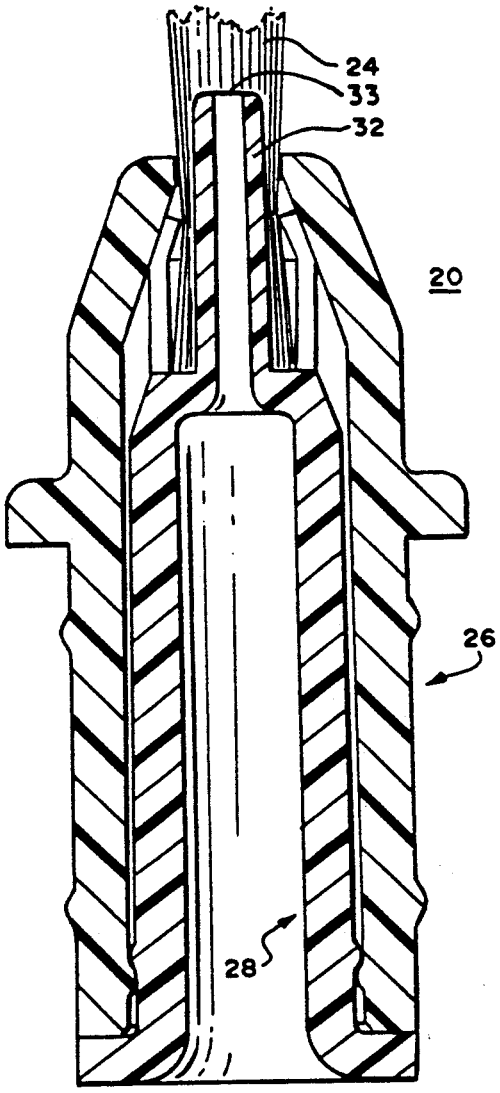
FIG. 8 is a sectional view showing another stage in the assembly of the inner and outer shell of FIGS. 6 and 7 in the fabrication of the brush holder of FIG. 1.

In FIG. 8, there is shown a longitudinal sectional view of the inner shell 28, the outer shell 26 and the flow-through brush 24 with the inner shell 28 and outer shell 26 fully engaged so that the stop surfaces mesh with each other and the groove and boss detents 40 and 58 respectively are engaged. In this position, the inner shell nose 32 extends out of the inner shell body passageway 34 and the clamp members 22A–22D (22A and 22C being shown in FIG. 8) are forced inwardly where they squeeze the brushes 24 against the nose 32 to hold them in place while permitting the outlet 33 to provide a flow path between the fluid in the applicator and the bristles of the brush 24.

Figure 9:
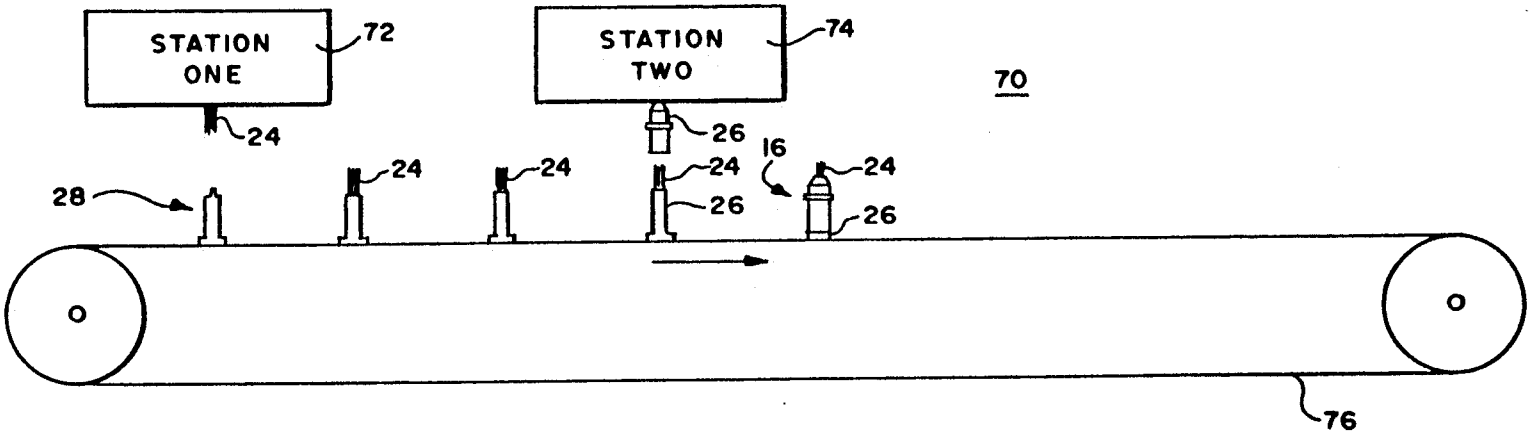
FIG. 9 is a schematic view of one series of steps performed in assembling the brush holder of FIG. 1.

In FIG. 9, there is shown a schematic drawing of an assembly system 70 having a conveyor belt 76 carrying in its top run a plurality of units to be fully assembled in a first station 72 and a second station 74. The inner shell 28 has the preformed brush with a flow-through center automatically inserted into the tubular outlet opening 38 over the nose 32 at station 72 and then it is moved to station 74 in which the outer shell 26 is inserted to form a firm holder for the brush 24. The tips 16 are then removed from the conveyor system (FIG. 9) at the end to be attached to the full container at its neck 14 (FIG. 1).

Figure 10:
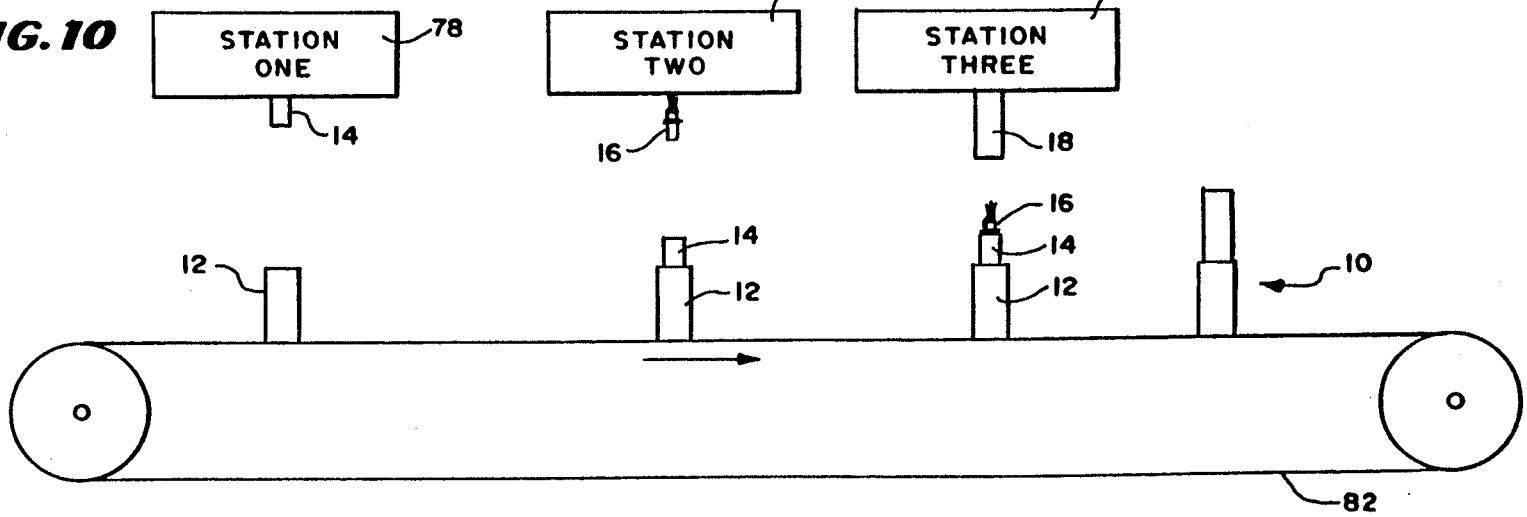
FIG. 10 is a schematic view of another portion of the assembly apparatus for assembling the brush holder of FIG. 1.

In FIG. 10, there is shown a schematic view of an assembly system 71 for assembling the tip 16 to containers which containers include a body portion 12 and a neck 14 (FIG. 1). As shown in this view, the body portion 12 and neck 14 are carried on a conveyor 82 and filled with a fluid at station 78. At station 80, the tip 16 is inserted over the neck 14 and heat-sealed in place or sealed by any other suitable means. The caps 18 are inserted at station 84. It is then removed from the conveyor 82 as a full flow-through brush container 10.

From the above description, it can be understood that the flow-through applicator 10 of this invention is simply and easily assembled and is economically made.

Although a preferred embodiment of the invention has been described with some particularlity, many modifications and variations in the preferred embodiment are possible within the light of the above teachings. Therefore, it is to be understood that, within the scope of the claims, the invention may be practiced other than as specifically described.

What is claimed is:

1. A flow-through brush applicator comprising:

an inner shell;

an outer shell;

said inner shell having means adapted to receive brushes and an outlet;

said outer shell having a substantially open bottom and an open top of smaller diameter than the open bottom;

said outer shell fitting conformingly over said inner shell with the outlet of said inner shell and brush extending beyond said outer shell, wherein fluid may flow from the interior of the inner shell through its outlet and around the brushes for application;

said brush being preformed as a cylinder with bristles forming an outer wall having a predetermined diameter and said inner shell having a groove with substantially the same diameter, wherein said brush fits within said groove;

clamp means for holding said bristles downwardly against said inner shell;

said clamp means including a plurality of segments of a truncated cone and said outer shell having a conical inner wall adjacent to said open top wherein said segments may be forced against said brush by said outer shell.

2. A flow-through applicator according to claim 1 in which said outer shell includes conical inner walls sized and positioned to move said plurality of segments of said truncated cone inwardly.

3. A flow-through applicator according to claim 1 further including a snap mechanism formed on said inner and outer shells wherein said inner and outer shells may be locked together to hold the brushes in place.

* * * * *